United States Patent [19]

Furukawa

[11] Patent Number: 4,723,935

[45] Date of Patent: Feb. 9, 1988

[54] METHOD AND APPARATUS FOR INSERTING A BAG INTO AN OUTER PACKAGING BOX

[76] Inventor: Takao Furukawa, 14-14, Kubo 3-chome, Onomichi-shi, Hiroshima, Japan

[21] Appl. No.: 7,015

[22] Filed: Jan. 27, 1987

[30] Foreign Application Priority Data

Jun. 26, 1986 [JP] Japan ..... 61-151163

[51] Int. Cl.[4] ..... B31B 7/00

[52] U.S. Cl. ..... 493/100; 53/175; 493/101

[58] Field of Search ..... 493/95, 100, 101, 386, 493/907, 175; 53/175, 575

[56] References Cited

U.S. PATENT DOCUMENTS 1,596,016 8/1926 Guillemin ..... 493/101
1,638,386 8/1927 Yancey ..... 493/100
1,993,751 3/1935 Reid ..... 493/101

FOREIGN PATENT DOCUMENTS 1574542 9/1980 United Kingdom ..... 493/100

*Primary Examiner*—Frederick R. Schmidt
*Assistant Examiner*—Robert Showalter
*Attorney, Agent, or Firm*—Barnes, Kisselle, Raisch, Choate, Whittemore & Hulbert

[57] ABSTRACT

A bag is put on a forming block while air streams are blown out through air holes of the forming block, then air streams are sucked through the air holes into the block so that the bag is attracted to the exterior of the block, and while this condition is kept, an outer packaging box is put on the block with the bag held therebetween. Subsequently, air streams are again blown out through the air holes to inflate the bag, and then the inflated bag and the outer packaging box are removed together form the forming blick. In this way, the bag is inserted in crease-free condition into the box.

2 Claims, 9 Drawing Figures

49
49
50
10
VAC
X COMP 40
50
10
16
VAC
X COMP

METHOD AND APPARATUS FOR INSERTING A BAG INTO AN OUTER PACKAGING BOX

FIELD OF THE INVENTION

This invention relates to a method and apparatus for inserting a flexible packaging bag opening at one end thereof neatly into an outer packaging box or case having greater rigidity than the bag while allowing the open end of the bag to be kept open.

BACKGROUND OF THE INVENTION

Generally, various kinds of goods, such as powder-form goods and foodstuffs, are packaged before they are shipped to their respective market, in such a way that the goods are for example, placed in a plastic or aluminum-foil laminated flexible bag, the bag being then sealed and put in a rigid plastic- or cardboard- made outer packaging box or case. Such outer packaging box usually has a design or trademark printed on the exterior thereof and has greater rigidity than the bag so that it also serves as a reinforcement for the bag.

If a sealed flexible bag in which goods are contained is to be received into an outer packaging box having a sectional area of same order as that of the bag, it has to be forcibly pushed into the box. This may sometimes result in the flexible bag breaking on account of friction with the inner surface of the box. To avoid such trouble, it has been a usual practice that the operator put his hands in the opening of the bag to expand the bag into shape, whereupon the bag is inserted into the outer packaging box so that the box and the bag are integrally fitted together, goods being then filled into the bag. In this way it is possible to place into an outer packaging box a bag having a sectional area of same order as that of the box and thereby to effect packaging such that there is no gap between the outer box and the bag at any corner of the box.

However, with such practice that a bag is placed into an outer packaging box while the bag is expanded by hand, the trouble is that the bag does not closely contact the inner surface of the box, there being caused pleat-like lines or bellows-like marks to the bag. Such phenomenon is particularly noticeable at bottom corners of the box and this often results in poor volumetric efficiency.

SUMMARY OF THE INVENTION

This invention is intended to overcome aforesaid difficulty with the prior art and has as its primary object the provision of a method and apparatus which permits a bag to be inserted into an outer packaging box without pleats or bellows being caused to the bag.

In order to accomplish this object, according to a first aspect of the invention, a method for inserting a flexible packaging bag opening at one end thereof into an outer packaging box having greater rigidity than the bag while the open end of the bag is kept open is provided which comprises placing the packaging bag, with its open end side down, over a forming block of a rectangular parallelepiped shape having a multiplicity of air holes open on the exterior thereof while causing streams of air to blow outward through the air holes; applying vacuum to the interior of said forming block after outward blow of air streams throgh the air holes is stopped, thus causing the bag to be attracted to the outer periphery of said forming block by inward suction of air through said air holes; placing the outer packaging box, with its open end side down, over said forming block with the bag held therebetween; again causing streams of air to blow outward through the air holes, then removing both the box and the bag in integral relation from said forming block when the bag is inflated full in the box.

According to this method, a flexible bag and a rigid outer packaging box are sequentially placed over the forming block while vacuum suction force and compressed air pressure are selectively caused to act as such in the forming block, so that the flexible bag is fitted into the rigid outer box by being inflated and contracted. Therefore, the method of the invention permits far much more efficient operation than the conventional method in which the operator inserts the bag into the outer box while holding the bag wide open by hand. Furthermore, the fact that the bag can be inserted into the box without pleats or bellows being caused to the bag so much improvement in volumetric efficiency. Another advantage is that when the bag with goods contained therein is taken out from the outer box, the bag is of a smooth three-dimensional configuration.

According to a second aspect of the invention, an apparatus for inserting a bag into an outer packaging box is provided which comprises a forming block of a rectangular parallelepiped shape which has a hollow interior and a multiplicity of air holes formed on the exterior of the block and which is fixedly mounted on a machine frame, two air lines connected at one end to the bottom of said forming block and at the other end to a vacuum source and a compressed air source respectively, on-off valves provided in said two air lines, and control means for operating said two on-off valves for communicating the interior of said forming block selectively with said vacuum and compressed air sources.

The control means may comprise a pair of pedals provided correspondingly to the two on-off valves. The pedals may be connected respectively to corresponding switch levers for the on-off valves through corresponding links. Each switch lever may be connected to bias means which keep the corresponding on-off valve normally in closed condition. For the bias means, tension springs are preferred.

BRIEF DESCRIPTION OF THE DRAWINGS

FIG. 2 is a perspective view of the forming block as it appears when the bag is brought in contact with the exterior of the block by air suction through the air holes after the bag is put on.

FIG. 5 is a perspective view of the forming block as it appears when the bag is inflated by air streams blown out through the air holes after the outer packaging box is put on.

DESCRIPTION OF THE PREFERRED EMBODIMENT

Figure 1:
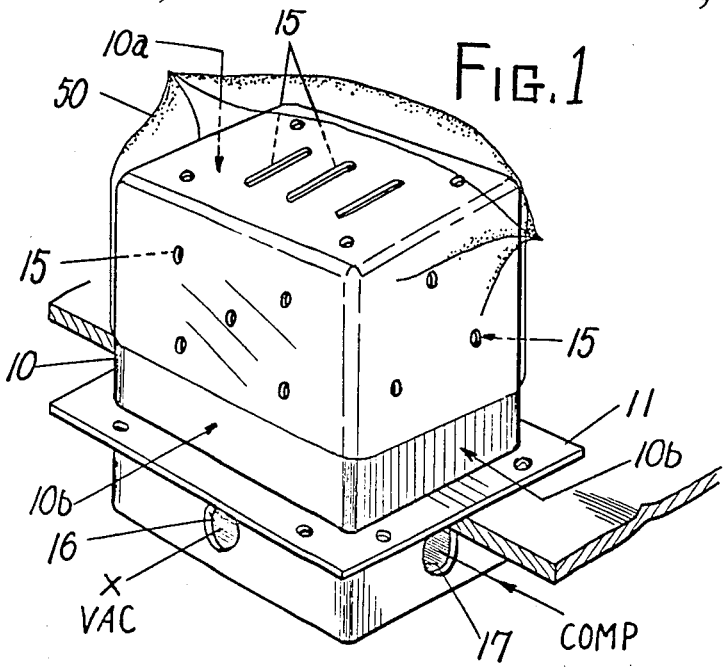
FIG. 1 is a perspective view of a forming block as it appears when a bag is put on it while streams of air are caused to blow out through air holes.

FIG. 1 shows a forming block 10 of a rectangular parallelepiped shape as seen obliquely from above. The block 10 has a flange 11 formed about a lower portion thereof, said flange 11 being secured by screws 13, 13 . . . to a table-type machine frame 12, as can be seen from FIGS. 8 and 9, whereby the block 10 is fixedly mounted on the machine frame 12. The forming block 10 has a hollow chamber 14 defined within the interior thereof and also has a multiplicity of air holes 15, 15 . . . bored through walls of its entire portion above the flange 11, including a ceiling 10*a* and four vertical sides 10*b*, 10*b* . . . Two line connection holes 16, 17 are provided on a portion below the flange 11.

A vacuum pump 19 consisting of a blower, and a compressor 20 are mounted on a bottom plate 18 of the table-type machine frame 12. A suction hole 21 of the vacuum pump 19 an the one line connection hole 16 are connected to each other through a pipe 22. A discharge hole 24 of the compressor 20 and the other line connection hole 17 in the forming block 10 are connected to each other through a pipe 25. Said two pipes 22, 25, i.e., air lines, are provided respectively with normally-closed type on-off valves 26, 27. On the bottom plate 18 of the machine frame 12 there are also provided two pedals 31, 32, which are connected respectively with control levers 28, 29 for said on-off valves 26, 27 through links 33, 34. Valve bodies disposed individually in the two on-off valves 26, 27 are normally kept in closed condition by the levers 28, 29, being hung by coil springs 35, 36, so that the air lines 22, 25 consisting of the two pipes are both in closed state.

Figure 8:
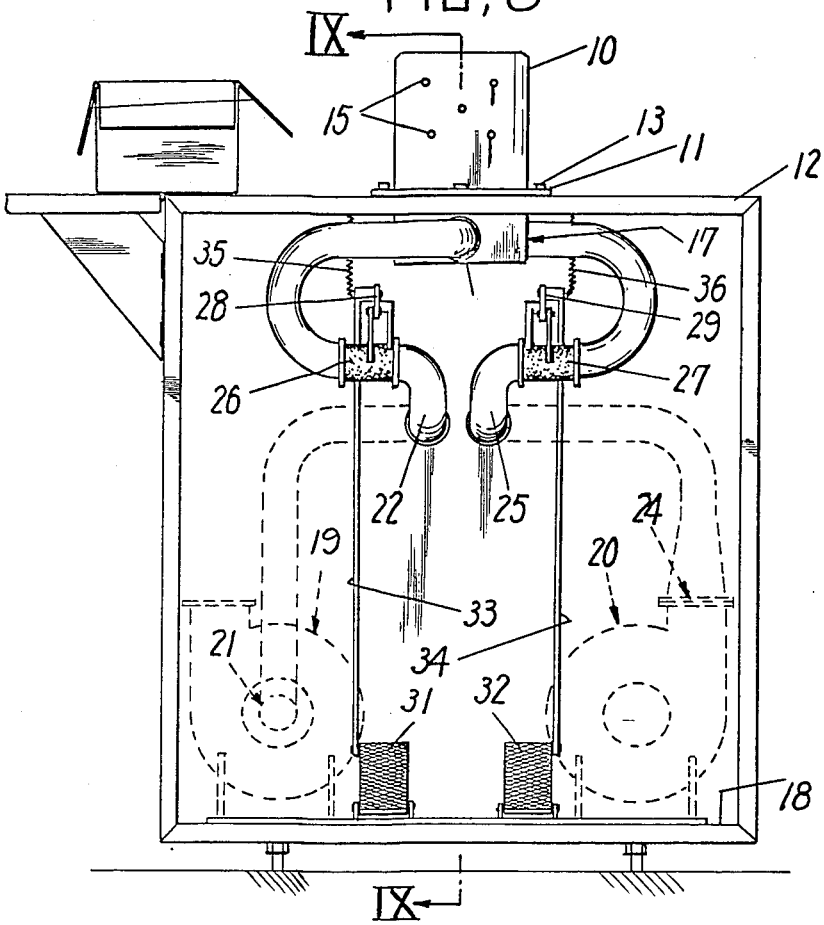
FIG. 8 is a front view showing an apparatus for inserting a bag into an outer packaging box.
Figure 9:
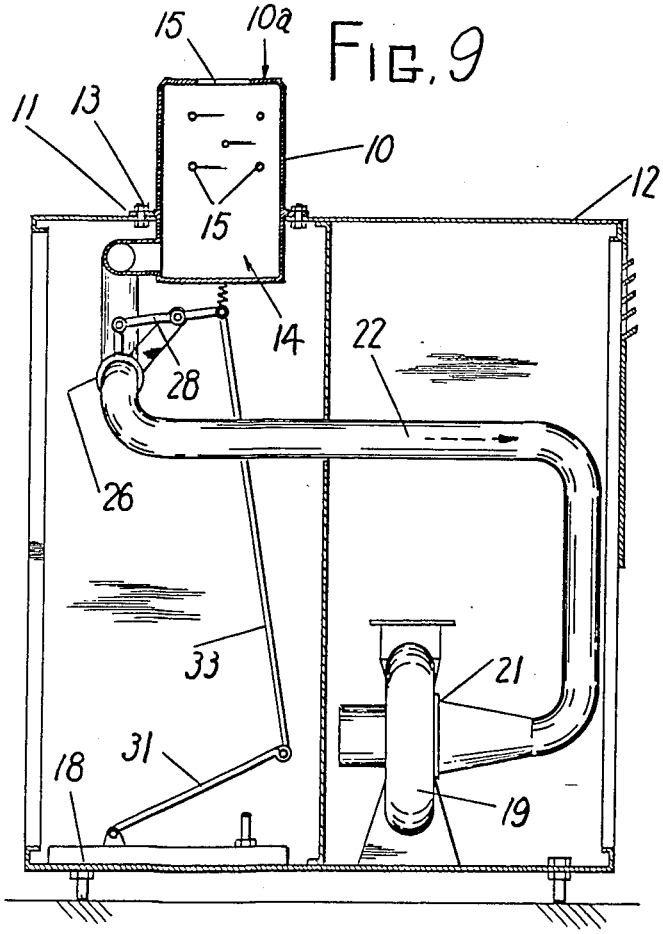
FIG. 9 is a section taken on line IX—IX in FIG. 8.

The apparatus being of such arrangement as above described, as the right pedal 32 in FIG. 8 is stepped on, pressure load is applied to the link 34 to actuate the lever 29 against the tensile force of the spring 36 so that the valve body in the on-off valve 27 is allowed to open the air line 25. Accordingly,compressed air generated by the compressor 20 is allowed to pass through the on-off valve 27 for entry into the forming block 10 and then to blow out through the multiplicity of air holes 15 while generating pressure within the block 10. Thereupon, the operator puts a bag 50 held open in his both hands on the block 10 in manner as shown in FIG. 1. In this case, the bag 50 is effectively inflated by streams of air blowing out through the air holes 15, so that it may be put smoothly in place on the forming block 10.

Figure 2:
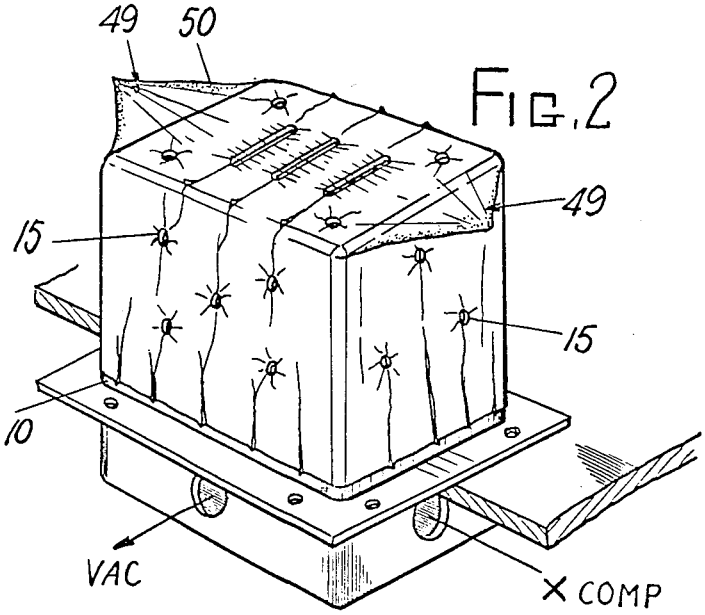

Subsequently, the load of foot pressure on the right pedal 32 in FIG. 8 is removed to close the on-off valve 27 and then the left pedal 31 is stepped on to apply pressure load to the link 33, whereby the lever 28 is actuated against the tensile force of the spring 35 to release the valve body in the on-off valve 26. Thereupon, the suction force of the vacuum pump 19 acts on the interior of the forming block 10. Accordingly, as shown in FIG. 2, the bag 50 put on the forming block 10 is allowed to fit close around the block 10 by the effect of suction through the air holes 15.

Figure 3:
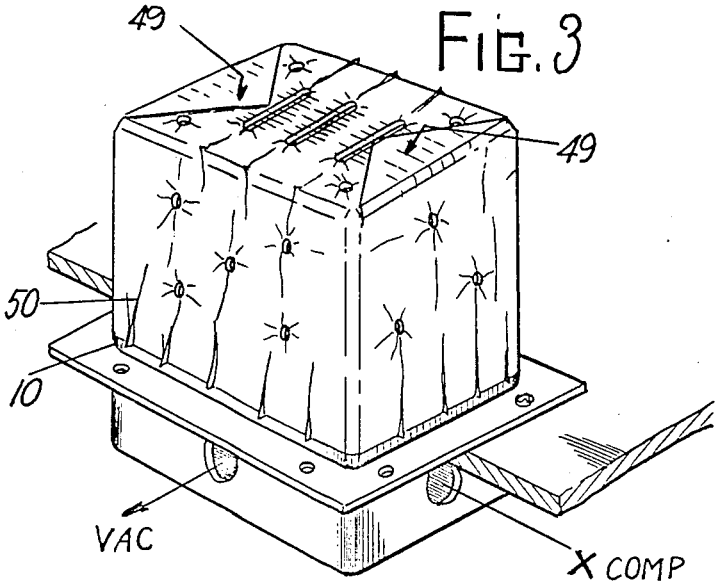
FIG. 3 is a perspective view of the forming block as it appears when triangular odd portions at both sides of the bag brought in close contact with the exterior of the block are inwardly folded down.
Figure 7:
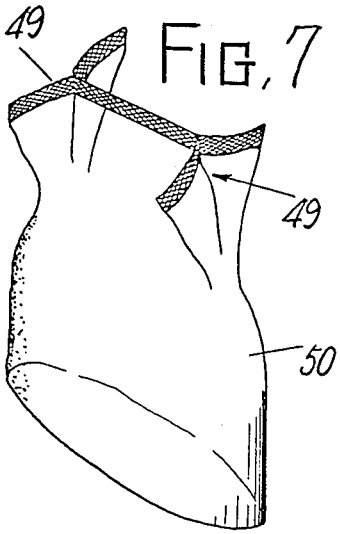
FIG. 7 is a perspective view showing another form of bag.

As may be appreciated from the drawings, when a plain bag 50 is put on the rectangular-parallelepiped shaped forming block 10, the difference in configuration between the two will naturally result in creation of triangular odd portions 49, 49 at both sides of the bag 50. Since no quantity of goods will be filled into these triangular odd portions 49, 49 in an outer packaging box 40 of a rectangular parallelepiped shape, it is desirable that the odd portions 49, 49 should be folded down on the bottom of the bag 50 as shown in FIG. 3. However, as shown in FIG. 7, where a bag 50 of the type which has two triangular odd portions 49, 49 preformed so as to get folded on the bottom of the bag is used, the folding work illustrated in FIG. 3 may be omitted.

Figure 4:
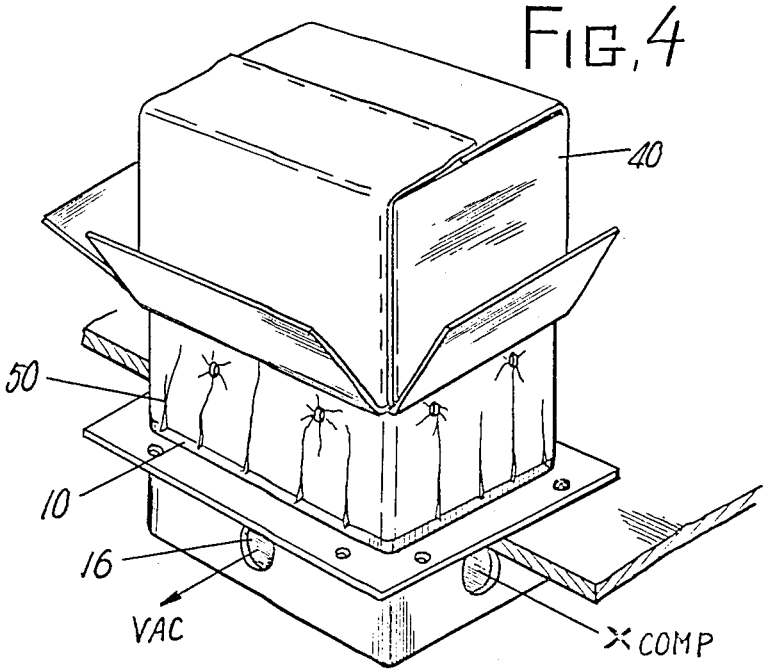
FIG. 4 is a perspective view of the forming block as it appears when an outer packaging box is being put on the block while the bag is kept in close contact with the exterior of the block.

Thereafter, as illustrated in FIG. 4, the outer packaging box 40 is fitted over the exterior of the bag 50 while vacuum is applied to the interior of the forming block 10 via the line connection hole 16. At this moment the bag 50 is in close contact with the exterior of the block 10, and therefore the outer packaging box 40 may be smoothly fitted over the exterior of the bag 50.

Figure 5:
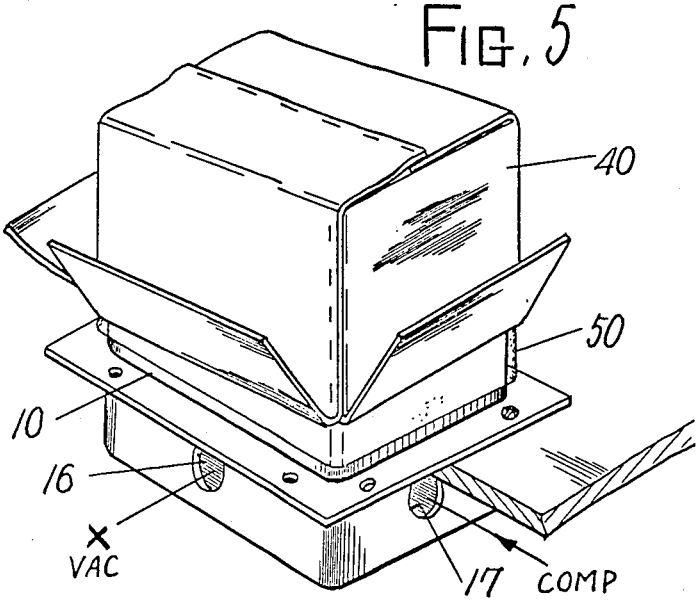
Figure 6:
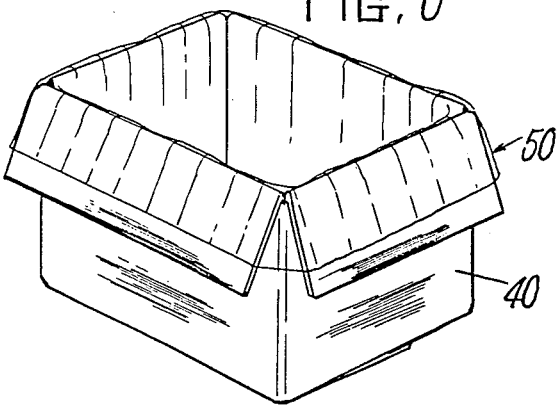
FIG. 6 is a perspective view showing the outer packaging box as it appears when the bag has been fitted therein.

Nextly, as illustrated in FIG. 5, the line connection hole 16 is closed and simultaneously the line connection hole 17 is opened to apply compressed air to the interior of the forming block 10 so that the bag 50 is inflated within the outer packaging box 40 by air streams blown out from the air holes 15, 15 . . . opening through the exterior of the forming block 10. When the bag 50 is so inflated, the outer packaging box 40 is lifted to a level above the block 10 and the bag 50 in expanded condition is accordingly removed from the block 10 together with the box 40. Thus, as shown in FIG. 6, a flexible bag 50 inserted in crease-free condition in an outer packaging box 40 can be obtained.

What is claimed is:

1. A method for inserting a flexible packaging bag open at one end thereof into an outer packaging box having greater rigidity than the bag while the open end of the bag is kept open, which comprises:

placing the packaging bag, with its open end down, over a forming block of a rectangular parallelepiped shape having a multiplicity of air holes open on the exterior thereof while causing streams of air to blow outward through the air holes to inflate the bag and enable it to be put smoothly in place over the forming block;

applying vacuum to the interior of said forming block after outward flow of air streams through the air holes is stopped, thus causing the bag to be attracted to the outer periphery of said forming block by inward suction of air through said air holes;

placing the outer packaging box, with its open end down, over said forming block with the bag held therebetween; and again causing streams of air to flow outward through the air holes to inflate the bag fully within the box, then removing both the box and the bag in integral relation from said forming block while the bag is inflated fully within the box as aforesaid.

2. The method as set forth in claim 1, wherein said air holes are formed in the top and all of the side surfaces of said forming block.

* * * * *